US007661369B2

(12) United States Patent
Theurer et al.

(10) Patent No.: US 7,661,369 B2
(45) Date of Patent: Feb. 16, 2010

(54) METHOD FOR REPLACING OLD TIES OF A RAILROAD TRACK WITH NEW TIES

(75) Inventors: Josef Theurer, Vienna (AT); Manfred Brunninger, Altenberg (AT)

(73) Assignee: Franz Plasser Bahnbaumaschinen-Industriegesellschaft mbH, Vienna (AT)

( * ) Notice: Subject to any disclaimer, the term of this patent is extended or adjusted under 35 U.S.C. 154(b) by 325 days.

(21) Appl. No.: 11/631,888

(22) PCT Filed: May 18, 2005

(86) PCT No.: PCT/EP2005/052284

§ 371 (c)(1),
(2), (4) Date: Jan. 8, 2007

(87) PCT Pub. No.: WO2006/008202

PCT Pub. Date: Jan. 26, 2006

(65) Prior Publication Data

US 2008/0302265 A1 Dec. 11, 2008

(30) Foreign Application Priority Data

Jul. 19, 2004 (AT) ..... GM511/2004

(51) Int. Cl.
*E01B 29/002* (2006.01)

(52) U.S. Cl. ..... 104/2; 104/7.3; 171/16; 37/104

(58) Field of Classification Search ..... 104/2, 104/7.1, 7.2, 7.3, 5, 8, 9, 10; 171/16; 37/104, 37/105, 106, 107; 414/339, 809
See application file for complete search history.

(56) References Cited

U.S. PATENT DOCUMENTS 5,052,132 A * 10/1991 Theurer et al. ..... 37/104
5,664,498 A * 9/1997 Theurer et al. ..... 104/6
6,450,101 B2 * 9/2002 Theurer et al. ..... 104/2
6,792,870 B2 9/2004 Theurer et al.

FOREIGN PATENT DOCUMENTS

EP 1 195 468 A1 4/2002
EP 1 396 577 A 3/2004

OTHER PUBLICATIONS

International Search Report PCT/EP2005/052284.

* cited by examiner

*Primary Examiner*—Mark T Le
(74) *Attorney, Agent, or Firm*—Collard & Roe, P.C.

(57) ABSTRACT

The invention relates to the replacement of old ties of a railway track by new ties. This aim can be achieved by spreading the two rails apart from each other. The reception of ballast gravel for producing a recess of ballast is carried out in a region below of the sleeper head of a ballast bed, which is located adjacent to the region of the old sleepers along their longitudinal axis. The received ballast gravel is temporarily stored and, once the new sleepers have been deposited, thrown off for the purpose of ballasting. In parallel and prior to the deposit of new sleepers, excess ballast gravel is ploughed in the recess of ballast so as to produce a leveled surface of ballast.

1 Claim, 1 Drawing Sheet

METHOD FOR REPLACING OLD TIES OF A RAILROAD TRACK WITH NEW TIES

Figure 1:
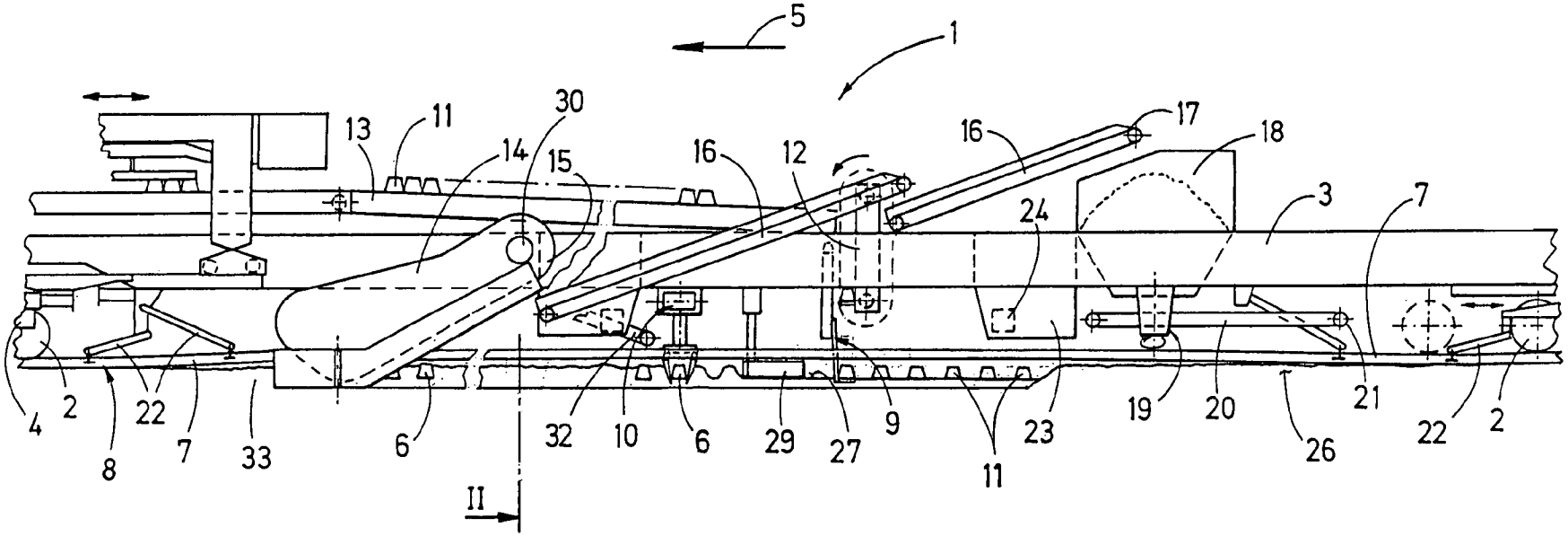

The invention relates to a method for replacing old ties of a railroad track with new ties, whereby rails that are released from the old ties are spread apart from one another laterally, and the production of a ballast level takes place before the new ties are laid down.

Such machines for replacing the ties and/or the rails of a railroad track are known, for example, from EP 1 195 468 A1 or U.S. Pat. No. 5,664,498.

The task of the present invention now lies in the creation of a method of the type stated, with which simplified replacement of ties is possible.

According to the invention, this task is accomplished with a method for replacing old ties of a railroad track with new ties, whereby rails that are released from the old ties are spread apart from one another laterally, and the production of a ballast level takes place before the new ties are laid down, wherein in a tie pre-head region of a ballast bed that follows the old ties in the tie longitudinal direction, ballast for producing a bed depression is picked up, temporarily stored, and, after the new ties have been laid down, thrown down to provide ballast for the ties, and wherein parallel to this, before the new ties are laid down, excess ballast is plowed into the bed depression, to produce the ballast level.

By means of the creation of a bed depression, removal of ballast that is situated above the ballast level is possible in a manner that can easily be implemented, in terms of design. Furthermore, the distance between the two devices for removing the ties and placing the ties, and therefore also the length of the machine frame required for bridging the construction gap, can be reduced.

Additional advantages of the invention are evident from the drawing.

In the following, the invention will be described in greater detail using exemplary embodiments shown in the drawing. This shows:

FIG. 1 a machine for replacing damaged ties, in a side view, and

Figure 2:
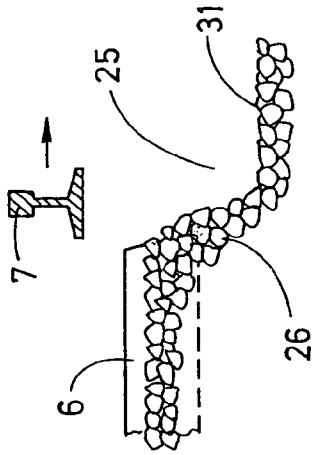

FIG. 2 a simplified cross-section through a ballast bed.

A machine 1 has a machine frame 3 supported at its ends on rail running gear mechanisms 2—in working use—and can be moved in a working direction 5 on a track 8 formed from old ties 6 and new ties 11, respectively, and rails 7 by means of a travel drive 4.

Approximately in the center between the two rail running gear mechanisms 2 at the two ends, a device 10 for picking up the old ties 6 and a device 9 for placing the new ties 11 are provided. The latter are taken over from a conveyor belt 13 by a vertical conveyor 12, and laid down onto a ballast level 27 of a ballast bed 33. Between the two devices 9 and 10, there is a ballast plow 29 that can be adjusted in height by means of drives, and is configured in V-shape, in a top view.

In the working direction 5, ahead of the device 10 for picking up the old ties 6, a flank chain 14 that is adjustable in height and crosswise, and is configured to be endless, is connected with the machine frame 3. This flank chain 14 can be rotated in a plane that is normal to the ballast level 27, and in a plane that runs in the longitudinal machine direction, by means of a drive 30.

An ejection opening 15 of the flank chain 14 has a conveyor belt 16 with an ejection end 17 assigned to it. The latter is situated above a ballast storage unit 18—positioned between the rear rail running gear mechanism 2 and the device 9 for laying down the new ties 11—which has an ejection device 19. The latter is configured as an ejection conveyor belt 20 having an ejection end 21, which belt is attached to the ballast storage unit 18 so as to rotate about a vertical axis. Between the two end-side track running gear mechanisms 2, there are rail guides 22 that are adjustable in height and crosswise. A control device 24 is assigned to a working cabin 23.

In the following, the method for replacing ties will be described in greater detail.

At the beginning of a work deployment, the two rails 7, released from the old ties 6, are spread apart from one another to a distance that exceeds the length of the ties, using the rail guides 22. While the machine 1 moves forward in the working direction 5, ballast 26 that is present in a tie pre-head region 25 (see FIG. 2) is picked up by means of lowering the flank chain 14, and ejected into the ballast storage unit 18 by way of the conveyor belt 16. In this connection, a bed depression 31 is produced by means of picking up the ballast.

The old ties 6 are picked up by the following device 10 and laid down onto a conveyor belt 32 to be transported away. Afterwards, excess ballast 26 is plowed by the ballast plow 29, i.e. displaced in the direction towards the bed depression 31, producing the ballast level 27. Immediately afterwards, the new ties 11 are laid down by the device 9. Subsequently, the rails 7 that were spread apart are brought back together to gauge, and laid down onto the new ties 11. Directly ahead of the rear rail running gear mechanism 2, stored ballast 26 is thrown down by way of the ejection conveyor belt 20, to fill up the intermediate compartments that lie between the new ties 11.

Within the scope of the invention, either two flank chains 14 that lie opposite one another in the crosswise machine direction, or alternatively, only one flank chain 14 can be used.

The invention claimed is:

1. A method for replacing old ties of a railroad track with new ties comprising the steps of:

(a) detaching rails from the old ties;

(b) spreading the rails apart from one another laterally;

(c) picking up ballast in a tie pre-head region of a ballast bed adjoining the old ties in a longitudinal direction of the old ties for producing a bed depression;

(d) temporarily storing the picked-up ballast;

(e) picking up the old ties;

(f) producing a ballast level while plowing surplus ballast into the bed depression;

(g) laying down the new ties; and (h) discharging the stored ballast for ballasting the new ties.

* * * * *